US009068241B2

(12) United States Patent
Mitsui et al.

(10) Patent No.: US 9,068,241 B2
(45) Date of Patent: Jun. 30, 2015

(54) METHOD OF PRODUCING ORE SLURRY

(75) Inventors: Hiroyuki Mitsui, Tokyo (JP); Osamu Nakai, Tokyo (JP)

(73) Assignee: SUMITOMO METAL MINING CO., LTD. (JP)

( * ) Notice: Subject to any disclaimer, the term of this patent is extended or adjusted under 35 U.S.C. 154(b) by 18 days.

(21) Appl. No.: 13/996,164

(22) PCT Filed: Jan. 24, 2012

(86) PCT No.: PCT/JP2012/051428
§ 371 (c)(1),
(2), (4) Date: Jun. 20, 2013

(87) PCT Pub. No.: WO2012/102265
PCT Pub. Date: Aug. 2, 2012

(65) Prior Publication Data

US 2013/0269485 A1 Oct. 17, 2013

(30) Foreign Application Priority Data

Jan. 25, 2011 (JP) ..... 2011-012502

(51) Int. Cl.
*C22B 1/00* (2006.01)
*C22B 23/00* (2006.01)

(52) U.S. Cl.
CPC ..... *C22B 1/00* (2013.01); *C22B 23/005* (2013.01)

(58) Field of Classification Search
CPC ..... C22B 23/005; C22B 1/00
USPC ..... 75/743
See application file for complete search history.

(56) References Cited

U.S. PATENT DOCUMENTS

| | | | | |
|---|---|---|---|---|
| 3,977,971 | A * | 8/1976 | Quinn et al. | 210/732 |
| 4,110,401 | A | 8/1978 | Hoover et al. | |
| 4,130,626 | A | 12/1978 | Hoover | |
| 4,362,558 | A | 12/1982 | Desnoes et al. | |
| 6,090,293 | A | 7/2000 | Cardini et al. | |
| 2005/0026591 | A1 | 2/2005 | Kissner et al. | |
| 2006/0020794 | A1 | 1/2006 | Oh | |
| 2011/0017676 | A1 * | 1/2011 | Franks et al. | 210/705 |

FOREIGN PATENT DOCUMENTS

| | | |
|---|---|---|
| AU | 775649 | 11/2002 |
| AU | 2008255186 | 8/2009 |
| JP | 11-80850 | 3/1999 |
| JP | 11-124640 | 5/1999 |
| JP | 2002-339020 | 11/2002 |
| JP | 2005-350766 | 12/2005 |
| JP | 2006-525104 | 11/2006 |
| JP | 2008-18999 | 1/2008 |
| JP | 2009-173967 | 8/2009 |
| WO | WO 2008124904 | * 10/2008 |

OTHER PUBLICATIONS

International Search Report of Apr. 24, 2012.
Japanese Office Action of Jun. 26, 2012.
European Patent Appl. EP12 73 9013—Supplementary European Search Report issued on Feb. 4, 2015.

* cited by examiner

*Primary Examiner* — George Wyszomierski
*Assistant Examiner* — Tima M McGuthry Banks
(74) *Attorney, Agent, or Firm* — Gerald E. Hespos; Michael J. Porco; Matthew T. Hespos

(57) ABSTRACT

A method of producing an ore slurry includes pulverizing and classifying steps as well as an ore slurry condensing step, wherein the slurry condensing step uses as a flocculant solution a diluted solution of the flocculant that satisfies the conditions of: (A) a flocculant molecular weight of $8\times10^6$ to $20\times10^6$ and (B) a flocculant dilution ratio of 0.1 to 0.5 g/L, and with respect to the added amount of the flocculant, a flocculant solution having an amount corresponding to 50 to 150 g of the flocculant amount per ton of dried solid components of the ore slurry is added to the ore slurry so as to be made in contact therewith for a sufficient period of time, with the temperature of the slurry being set in a range from 35 to 45° C. upon transporting the slurry from the condensing step to the next process.

2 Claims, No Drawings

METHOD OF PRODUCING ORE SLURRY

BACKGROUND

1. Field of the Invention

The present invention relates to a method for condensing an ore slurry in an ore treatment process of preparing an ore slurry from crude ores of nickel oxide ores that have been mined, and more specifically concerns a method in which in a condensing step of the ore slurry, by using a combination of a method for specifying the molecular weight of a flocculant and the dilution ratio upon addition thereof, a method for specifying the added amount of the flocculant and a method for specifying the ore slurry temperature after concentration, the concentration and viscosity of the ore slurry are adjusted so that it becomes possible to prevent the slurry from causing a failure to be transported to a leaching process that is the post process.

2. Description of the Related Art

In recent years, a high temperature and pressure acid leach method (sometimes referred to as "HPAL method") using sulfuric acid, which is one of wet-smelting methods, has been utilized, as a smelting method in which, from nickel oxide ores containing nickel and cobalt respectively in a range from about 1.0 to 2.0% and in a range from about 0.1 to 0.5%, relative to the entire amount, as crude ores, nickel and cobalt are recovered.

This HPAL method is a smelting method including a leaching process in which, for example, sulfuric acid is added to an ore slurry of nickel oxide ore so that the slurry is leached under a high temperature and a high pressure to obtain a leachate containing nickel and cobalt; a neutralizing process in which the pH of the leachate containing impurity elements together with nickel and cobalt is adjusted so as to form a neutralized precipitate slurry containing impurity elements, such as iron, and a nickel recovering base solution that has been purified; and a sulfiding process in which a hydrogen sulfide gas is supplied to the nickel recovering base solution so that a nickel-cobalt mixed sulfide and a barren solution are formed (for example, see Japanese Patent Application Laid-Open No. 2005-350766).

In this method, generally, 90% or more of nickel and cobalt in the ore slurry are leached in the leaching process. Next, after the leachate has been separated, impurities in the leachate are separated and removed therefrom by a neutralizing method. Moreover, the nickel grade in the nickel-cobalt mixed sulfide thus obtained is 55 to 60%, and the cobalt grade therein is about 3 to 6% so that this is used as an intermediate material in the nickel-cobalt smelting process.

Here, the ore slurry of nickel oxide ores to be used is normally subjected to an ore treatment process for preparing a charging material into a smelting step from the crude ores after having been mined.

In this ore treatment process of the nickel oxide ores, for example, low-grade nickel oxide ores having a nickel grade of about 1.0 to 2.0% is formed into a slurry having a predetermined particle size and a concentration by classifying (sieving) and pulverizing steps including a multiple steps, and recovered and transferred to the leaching process as the post process.

More specifically, the ore treatment process is mainly classified into pulverizing and classifying steps and an ore slurry condensing step. In the pulverizing and classifying steps, crude ores are pulverized in a wet-type facility so that oversized particles and mixed matters are removed therefrom (for example, see Japanese Patent Application Laid-Open No. 2009-173967).

Since the ore slurry thus produced contains excessive moisture, the excessive moisture contained therein is removed in the next ore slurry condensing step (for example, see Japanese Patent Application Laid-Open No. H11-124640).

Since ore components contained in the ore slurry per same transporting amount are increased by this moisture removal, this process has an additional effect for improving the operating efficiency of the entire plant.

However, only condensing the ore slurry sometimes tends to make the viscosity of the ore slurry too high, and in such a case, the transporting capability of a pump for use in transporting the ore slurry from the ore treatment process to leaching process is exceeded. For this reason, a transporting failure occurs to cause a temporarily stoppage of the plant, and a subsequent reduction in the operating efficiency.

For this reason, in the operations of the conventional plant, the solid component concentration can be raised only within a range capable of carrying out the slurry transportation, and the resulting problem is that a high slurry solid component concentration and such a low-level yield stress as to easily allow the slurry transportation are not simultaneously satisfied.

The present invention has been devised to solve these problems, and its object is to provide a method of producing an ore slurry that has such a low-level yield stress as to easily allow a slurry transportation even when the slurry has a high concentration, so that no problems are raised in the transportation.

SUMMARY OF THE INVENTION

The inventors of the present invention have found that, in an ore slurry condensing step, by specifying the molecular weight of a flocculant and the dilution ratio upon addition thereof, as well as the added amount of the flocculant, and by also specifying the temperature of the ore slurry after the concentration, an ore slurry whose concentration and viscosity have been adjusted is prepared so that it becomes possible to prevent the slurry from causing a failure to be transferred to a leaching process that is the post process.

That is, the method of producing an ore slurry of the present invention relates to a method of producing an ore slurry that is used for recovering nickel and cobalt from nickel oxide ores by using a high temperature and pressure acid leach method utilizing sulfuric acid, and includes pulverizing and classifying steps as well as an ore slurry condensing step, and the method is characterized in that the slurry condensing step uses as a flocculant solution a diluted solution of the flocculant that satisfies the conditions of (A) a flocculant molecular weight of 8 to $20\times10^6$ and (B) a flocculant dilution ratio of 0.1 to 0.5 g/L, and in that with respect to the added amount of the flocculant, a flocculant solution having an amount corresponding to 50 to 150 g of the flocculant amount per ton of dried solid components in the ore slurry is added to the ore slurry so as to be made in contact therewith for a sufficient period of time, with the temperature of the slurry being set in a range from 35 to 45° C. upon transporting the slurry from the condensing step to the next process.

The method of producing an ore slurry of the present invention provides an ore slurry having such a low-level yield stress as to easily allow a slurry transportation even when the slurry has a high concentration, so that no problems are raised in the transportation, and since a high operating efficiency can be maintained without causing an increase in equipment costs, its industrial value is very high and superior effects can be obtained.

DETAILED DESCRIPTION OF THE PREFERRED EMBODIMENTS

The following description will discuss the method of producing an ore slurry of the present invention in detail.

The method of the present invention corresponds to a method to be applied to an ore slurry producing process serving as an ore treatment process for use in recovering nickel and cobalt from nickel oxide ores by a high temperature and pressure leach method (HPAL method) using sulfuric acid.

This ore treatment process includes pulverizing and classifying steps in which unnecessary matters contained in the ores are removed and the grain size of the ores is adjusted to have a particle size of 1.4 mm or less so that a mixture (hereinafter, sometimes referred to as a coarse ore slurry) of water and ore particles having a solid-component concentration in a range of 8 to 12% by weight is obtained, and a slurry condensing step in which the coarse ore slurry is condensed, that is, reduced in its moisture, so as to obtain an ore slurry capable of being transported to the next process and thereafter.

First, in the slurry condensing step, the coarse ore slurry is charged into a solid-liquid separation device, such as a thickening apparatus, so that solid components are precipitated and taken out from a lower portion of the device, and moisture forming a supernatant solution is overflowed from an upper portion of the device so as to be solid-liquid separated so that the moisture is reduced; thus, in this method, the coarse ore slurry is condensed, and an ore slurry having about 40% by weight as an appropriate solid-component concentration to be transported to the next process can be obtained.

If necessary, upon charging the coarse ore slurry into the solid-liquid separation device, a flocculant is sometimes added thereto so as to accelerate the flocculant thereof and consequently accelerate the precipitation thereof. As such a flocculant, for example, those polymer-based flocculants having various molecular weights may be used. The flocculant is appropriately diluted and mixed with a coarse ore slurry and sufficiently made in contact therewith so that its effects are exerted, and in order to be sufficiently made in contact therewith, in general, the flocculant having been diluted is added into a coarse ore slurry flow, for example, at a feed well portion of the thickening apparatus. At this time, in order to efficiently carry out operations in the next process and thereafter, it is important to set the concentration of the ore slurry to a value exceeding 40% by weight.

On the other hand, the viscosity of the ore slurry is essentially set to 200 Pa or less, as a value obtained as a yield stress of a slump test value. The reason for this is because in the case of a general inexpensive pump, its pump capability of transporting the ore slurry to the next process is limited to 200 Pa in its yield stress.

Additionally, the yield stress measurements of the ore slurry can be carried out by slump tests.

The slump tests are carried out by a method that is well-known at actual operation fields in which the ore slurry is dealt with, and this method is similar to a slump test method (JIS A 1101) for concrete, and the outline of the slump tests is explained below.

A slurry is filled into a cylindrical pipe, and this is kept in an upright state on a horizontal plane so that, when only the pipe is gently drawn off upward, the pillar of the slurry has a lower height with an expanded bottom portion by its own gravity.

Supposing that the height of the cylindrical pipe is $H_0$ (÷height of the slurry pillar immediately after the pipe has been drawn off) and that the height of the slurry after having been deformed by its own gravity is H1, with the rate of changes being set to S, S is represented by the following equation (1), and when the density of the slurry is found as γ [g/L], by substituting this for the following equation 2, the yield stress [Pa] can be found.

[Equation 1]

$$S=(H_0-H_1)/H_0 \quad (1)$$

[Equation 2]

$$\text{Yield stress [Pa]}=0.5\times(1-S^{0.5})\times\gamma\times0.98\times H_0 \quad (2)$$

In the method of producing an ore slurry of the present invention, upon selecting a flocculant to be used, one of those flocculants having a molecular weight in a range from 8 to $20\times10^6$ is selected and used. Moreover, with respect to the dilution ratio of the flocculant, the flocculant is diluted with water so as to have a concentration of 0.1 to 0.5 g/L.

The diluting method is not particularly limited, and in the case of a small amount thereof, for example, 100 L of water is put into 200 L of a steel drum, and about 10 to 50 g of flocculant is charged thereto and stirred with a general-use hand mixer having shafts of about 1 to 2 meters for about 10 minutes, while in the case of a large amount thereof, by using a larger facility, the same stirring state may be prepared.

With respect to the added amount of the flocculant, per ton of dried solid components contained in the coarse ore slurry, a flocculant solution corresponding to 50 to 150 g of the amount of the flocculant is added to the ore slurry.

Moreover, upon drawing out the ore slurry from the solid-liquid separation device, it is important to control the temperature thereof in a range of 35 to 45° C.

In the case when the ore slurry thus adjusted has a temperature lower than 35° C., its viscosity becomes higher to cause a yield stress of about 400 Pa in some cases, resulting in a possibility of failure in a normal transporting pump; in contrast, in the case when it has a temperature higher than 45° C., it is preferable because the viscosity is lowered to make the transporting process easier as long as it is not such a high temperature as to cause, for example, a boiling slurry during the transportation and the subsequent difficulty in handling; however, since no further effects are expected, the temperature is preferably set to 45° C. or less.

As the method for controlling the temperature of the ore slurry, not particularly limited, it is achieved by charging a coarse ore slurry whose temperature is controlled within a predetermined range into the solid-liquid separation device, or by detachably attaching a temperature maintaining device or a cooling device onto an outer wall of the solid-liquid separation device.

Moreover, within a section prior to transporting the ore slurry prepared within the above-mentioned temperature range to the next process, the corresponding pipes and devices are preferably controlled to be maintained within a predetermined temperature range, and the same controlling method may be used.

Another more preferable condition is to build the corresponding plant in a tropical zone or a semi-tropical zone where there are not so many fluctuations in room temperature and outside temperature all through the year, and this condition makes it possible to more easily carry out the control method. In particular, in the pulverizing and classifying steps of the ores, the temperature of the coarse ore slurry becomes slightly higher than room temperature and ambient temperature due to heat transmitted from the devices and applied kinetic energy so that it becomes easier to control the ore slurry to an optimal temperature range of 35 to 45° C.; thus, these are considered to be desirable areas.

As described above, by carrying out the present invention, the viscosity of the ore slurry obtained by precipitating and condensing operations allows the yield stress of the ore slurry to be set to 200 Pa or less so that without the necessity of using a pump for a high-viscosity slurry (for example, chassis pump), the transporting process can be carried out by using an inexpensive general-use pump (for example, centrifugal pump) so that it is possible to provide operations with high efficiency without causing high costs in facilities.

In the case of a flocculant having a molecular weight of less than $8\times10^6$, since the effect of flocculation is too low, it takes too much time to precipitate, failing to provide sufficient effects. Moreover, in the case of a flocculant having a molecular weight greater than $20\times10^6$, the coagulating and condensing effects become too high, failing to set the slurry within an appropriate viscosity range; thus, the application of this is also undesirable.

With respect to the dilution ratio of the flocculant, a diluting process with water is carried out so that the concentration of the flocculant is set in a range from 0.1 to 0.5 g/L, and in the case of the concentration of less than 0.1 g/L, the total amount of liquids (coarse ore slurry +diluted solution of flocculant) to be charged into the solid-liquid separation device increases, failing to provide an efficient operation; in contrast, in the case of the concentration higher than 0.5 g/L, since it becomes difficult to make the coarse ore slurry and the diluted solution of the flocculant sufficiently in contact with each other (mixed with each other), the application of this is undesirable.

Moreover, with respect to the added amount of a flocculant, a flocculant solution, which contains an amount of the flocculant corresponding to 50 to 150 g per ton of the dried solid components in the coarse ore slurry, is added, and in the case of a range less than 50 g, the effects of the flocculant become insufficient, making it difficult to carry out a target condensing process; in contrast, in the case of 150 g or more, the application of this is not desirable because no further effects can be expected.

In addition to the above-mentioned molecular weight of the flocculant, the dilution ratio of the flocculant, and the added amount of the flocculant, by controlling the temperature of an ore slurry in a temperature range of 35 to 45° C. that is the preferable temperature range, it is possible to achieve the viscosity of the ore slurry that allows the resulting slurry to have a yield stress of 200 Pa or less, and the inventors, etc. consider that this is achieved because of an optimal combination of these set conditions.

EXAMPLES

The following description will discuss the present invention in detail by means of examples and comparative examples.

Example 1

By using a high temperature and pressure acid leach method (HPAL method) using sulfuric acid, in a production process of an ore slurry serving as an ore treatment process for use in recovering nickel and cobalt from nickel oxide ores, a coarse ore slurry containing 100 g/L of solid components was produced in pulverizing and classifying steps.

This coarse ore slurry was charged into a thickening apparatus having a diameter of about 25 m, a height of about 5 m and a volume of about 2000 $m^3$, at a flow rate of 250 $m^3$/hour.

At this time, the flocculant was added thereto under the following conditions:

The molecular weight of the flocculant was $9.0\times10^6$, the dilution ratio of the flocculant diluted solution was 0.03% by weight, and the flocculant diluted solution was charged thereto at an addition flow rate of 10 $m^3$/hour (100 g of flocculant charged per ton of the ores).

Moreover, an alumel-chromel-type thermocouple was installed at a precipitation portion of the thickening apparatus, and temperature measurements were carried out so as to maintain a temperature of 35° C.

As a result, the yield stress of the ore slurry thus produced was set to 180 Pa, and it was possible to transport the ore slurry to the next process by using a general-use centrifugal pump.

Moreover, the solid component concentration of the ore slurry was 44% by weight, which was a sufficient result.

Table 1 shows the molecular weight of the flocculant, the concentration of the flocculant, the yield stress of the ore slurry and the solid-component concentration of the ore slurry obtained at this time.

Here, the yield stress of the ore slurry was found by slump tests, and a cylindrical pipe used therein had an inner diameter of 5 cm and a height of 8.5 cm.

Comparative Example 1

The same operations as those of example 1 were carried out except that the molecular weight of the flocculant was changed to $2.5\times10^6$.

As a result, the yield stress of the produced ore slurry was 400 Pa, and it was not possible to transport the ore slurry to the next process by utilizing a general-use centrifugal pump.

Although the solid-component concentration of the ore slurry was 44% by weight, which was a sufficient result, the operations had to be suspended because no transporting process was available.

Table 1 also shows the molecular weight of the flocculant, the concentration of the flocculant, the yield stress of the ore slurry and the solid-component concentration of the ore slurry obtained at this time.

Comparative Example 2

The same operations as those of example 1 were carried out except that the temperature of the ore slurry was set to 25° C., without using the flocculant.

As a result, the yield stress of the produced ore slurry was 230 Pa, and it was not possible to transport the ore slurry to the next process by utilizing a general-use centrifugal pump.

Moreover, the solid-component concentration of the ore slurry was 39% by weight, which was a low level and caused an insufficient result.

Table 1 also shows the molecular weight of the flocculant, the concentration of the flocculant, the yield stress of the ore slurry and the solid-component concentration of the ore slurry obtained at this time.

Comparative Example 3

The same operations as those of example 1 were carried out, without using the flocculant.

As a result, the yield stress of the produced ore slurry was 180 Pa, and it was possible to transport the ore slurry to the next process by utilizing a general-use centrifugal pump.

However, the solid-component concentration of the ore slurry was 39% by weight, which was a low level and caused an insufficient result.

Table 1 further shows the molecular weight of the flocculant, the concentration of the flocculant, the yield stress of the ore slurry and the solid-component concentration of the ore slurry obtained at this time.

TABLE 1

| | Molecular Weight of Flocculant | Temperature [° C.] of Ore Slurry | Dilution Ratio [% by weight] of Flocculant | Yield Stress of Ore Slurry [Pa] | Solid-Component Concentration [% by weight] of Ore Slurry |
|---|---|---|---|---|---|
| Example 1 | $9.0 \times 10^6$ | 35 | 0.03 | 180 | 44 |
| Comparative Example 1 | $2.5 \times 10^6$ | 35 | 0.03 | 400 | 44 |
| Comparative Example 2 | Not used | 25 | — | 230 | 39 |
| Comparative Example 3 | Not used | 35 | — | 180 | 39 |

What is claimed is:

1. A method of producing an ore slurry that is used for recovering nickel and cobalt from nickel oxide ores by using a high temperature and pressure acid leach method utilizing sulfuric acid, the method comprising:

pulverizing and classifying steps as well as an ore slurry condensing step, wherein the slurry condensing step uses as a flocculant solution a diluted solution of the flocculant that satisfies the following conditions of:

(A) a flocculant molecular weight of $8\times10^6$ to $20\times10^6$ and (B) a flocculant dilution ratio of 0.1 to 0.5 g/L, and wherein with respect to the added amount of the flocculant, a flocculant solution having an amount corresponding to 50 to 150 g of the flocculant amount per ton of dried solid components in the ore slurry is added to the ore slurry so as to be made in contact therewith for a sufficient period of time, with the temperature of the slurry being set in a range from 35 to 45° C. upon transporting the slurry from the condensing step to the next process.

2. A method of producing an ore slurry that is used for recovering nickel and cobalt from nickel oxide ores by using a high temperature and pressure acid leach method utilizing sulfuric acid, the method comprising:

pulverizing and classifying the ore to produce an ore slurry;

providing a flocculant solution diluted to satisfy the following conditions of:

(A) a flocculant molecular weight of $8\times10^6$ to $20\times10^6$ and (B) a flocculant dilution ratio of 0.1 to 0.5 g/L;

adding the flocculant solution to the ore slurry in an amount corresponding to 50 to 150 g of the flocculant per ton of dried solid components in the ore slurry and for a sufficient period of time to produce a condensed ore slurry;

setting a temperature of the condensed slurry to a range from 35 to 45° C.; and transporting the condensed slurry to a location for performing leaching with the temperature of the condensed slurry being maintained in the range during the transporting.

* * * * *